US007476182B2

(12) United States Patent
DeNisco

(10) Patent No.: US 7,476,182 B2
(45) Date of Patent: Jan. 13, 2009

(54) HORIZONTAL HAMSTRING STRETCHER

(76) Inventor: Christopher R. DeNisco, 325 Greenwood Dr., Key Biscayne, FL (US) 33149

( * ) Notice: Subject to any disclaimer, the term of this patent is extended or adjusted under 35 U.S.C. 154(b) by 146 days.

(21) Appl. No.: 11/203,705

(22) Filed: Aug. 15, 2005

(65) Prior Publication Data

US 2007/0037676 A1 Feb. 15, 2007

(51) Int. Cl.
*A63B 21/00* (2006.01)

(52) U.S. Cl. ..... 482/92; 482/907

(58) Field of Classification Search ..... 482/92, 482/145–146, 907, 112, 142, 79–80, 121–130
See application file for complete search history.

(56) References Cited

U.S. PATENT DOCUMENTS

| | | | | |
|---|---|---|---|---|
| 3,285,070 | A * | 11/1966 | McDonough | 73/379.01 |
| 4,226,415 | A * | 10/1980 | Wright | 482/113 |
| 4,602,618 | A | 7/1986 | Berze | |
| 5,067,709 | A * | 11/1991 | Christianson | 482/95 |
| 5,160,305 | A * | 11/1992 | Lin | 482/142 |
| 5,232,427 | A | 8/1993 | Paro | |
| 5,261,865 | A * | 11/1993 | Trainor | 482/95 |
| 5,277,681 | A * | 1/1994 | Holt | 482/112 |
| 5,333,604 | A * | 8/1994 | Green et al. | 601/33 |
| 5,364,326 | A * | 11/1994 | Smith et al. | 482/113 |
| 5,405,306 | A | 4/1995 | Goldsmith et al. | |
| 5,480,375 | A | 1/1996 | La Fosse et al. | |
| 5,498,222 | A * | 3/1996 | Hur | 482/112 |
| 5,558,607 | A | 9/1996 | Darling | |
| 5,634,873 | A | 6/1997 | Carlstrom | |
| 5,662,591 | A * | 9/1997 | Peindl et al. | 601/24 |
| 5,662,592 | A | 9/1997 | Brady | |
| 5,730,706 | A * | 3/1998 | Garnies | 601/23 |
| 5,746,688 | A * | 5/1998 | Prager | 482/142 |
| 5,752,879 | A * | 5/1998 | Berdut | 482/96 |
| 5,913,759 | A * | 6/1999 | Bostrom | 482/142 |
| 5,938,573 | A | 8/1999 | Davies, III et al. | |
| 5,938,574 | A | 8/1999 | Webber | |
| 5,984,845 | A | 11/1999 | Powers | |
| 6,019,740 | A * | 2/2000 | Hausman | 601/24 |
| 6,422,981 | B1 * | 7/2002 | Riser | 482/142 |
| 6,500,099 | B1 * | 12/2002 | Eschenbach | 482/57 |
| 6,547,705 | B2 * | 4/2003 | Yu | 482/112 |
| 6,685,607 | B1 * | 2/2004 | Olson | 482/142 |
| 6,939,272 | B1 * | 9/2005 | Wu | 482/92 |
| 6,966,872 | B2 * | 11/2005 | Eschenbach | 482/142 |
| 2005/0181917 | A1 * | 8/2005 | Dayal | 482/142 |
| 2006/0035769 | A1 * | 2/2006 | Phillips | 482/123 |

* cited by examiner

*Primary Examiner*—Lori Amerson
(74) *Attorney, Agent, or Firm*—Holland & Knight LLP; Brian J. Colandreo

(57) ABSTRACT

An exercise machine includes: a bench for a user to lie upon; an actuator arm comprising a first end connected to the bench and a second end comprising a foot attachment for attaching to a human foot; the actuator arm comprising an actuator for moving the actuator arm such that a user's leg is moved into a stretching position; and a user control for causing the actuator to actuate.

5 Claims, 2 Drawing Sheets

HORIZONTAL HAMSTRING STRETCHER

FIELD OF THE INVENTION

The invention disclosed broadly relates to the field of exercise machines and more particularly to an exercise machine for assisting a user to stretch his or her hamstring.

BACKGROUND OF THE INVENTION

There are many exercise machines in the market today. However, there are no known machines that assist a user to stretch his or her hamstring easily and with low risk of injury. Therefore there is a need for such a machine.

SUMMARY OF THE INVENTION

Briefly, according to an embodiment of the invention, an exercise machine includes: a bench for a user to lie upon and an actuator arm comprising a first end connected to the bench and a second end comprising a foot attachment for attaching to a human foot. The actuator arm also includes an actuator piston for moving the actuator arm such that a user's leg is moved into a stretched position; and a user control for causing the actuator to stretch the user's leg.

DETAILED DESCRIPTION

Figure 1:
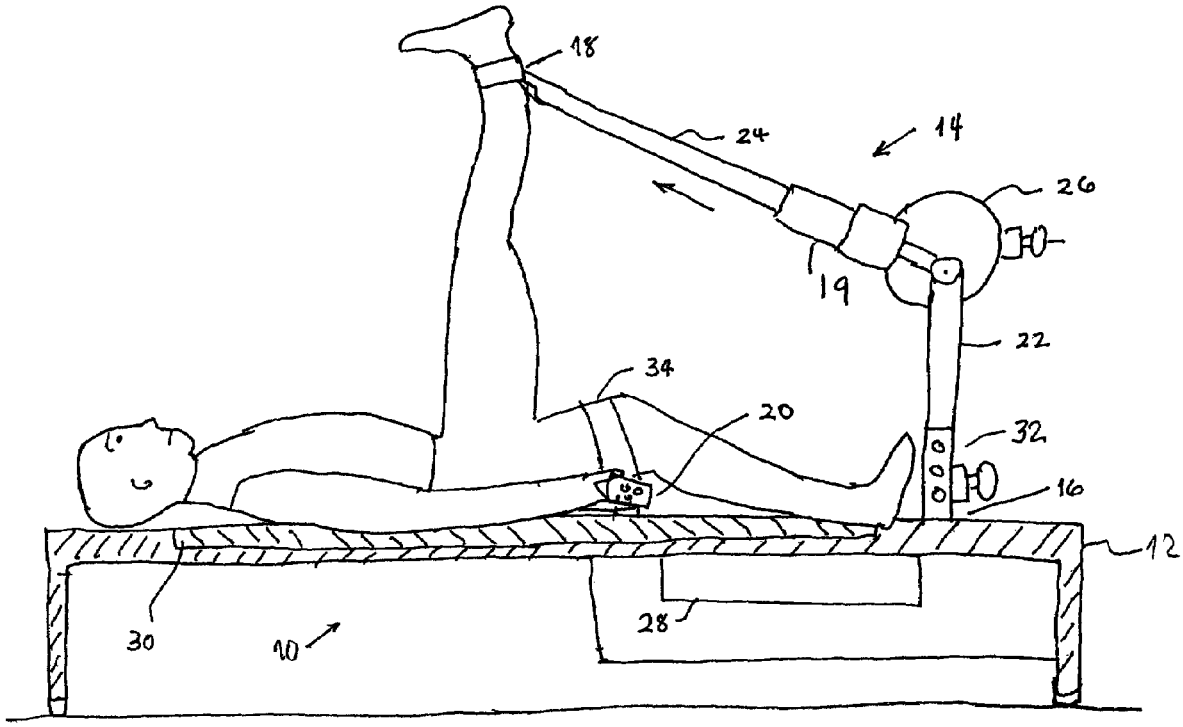
FIG. 1 shows an exercise machine for assisting a user to stretch his or her hamstring.

Referring to FIG. 1, there is shown an exercise machine 10 for assisting a user to stretch his or her hamstring according an embodiment of the invention. The exercise machine 10 includes a bench 12 for a user to lie upon and an actuator arm 14 to move the leg of its user into a stretched position. In this embodiment, the actuator arm 14 is a two-part assembly including a first end 16 connected to the bench 12 and a second end comprising a foot attachment 18 for attaching to a human foot. The actuator arm 14 also includes an actuator 19 for moving the actuator arm 14 such that a user's leg is moved into a stretching position; and a user control 20 for causing the actuator 19 to move the user's leg.

The actuator arm 14 comprises a first member 22 with a connection to the bench 12 and a second member 24 comprising the foot attachment 18 and wherein the first and second members are connected to each other by a joint 26 allowing freedom of movement such that the members form a variable angle with respect to each other. In this embodiment, the second member 24 comprises the actuator piston and the joint comprises a manually adjustable gear for altering the variable angle.

Figure 2:
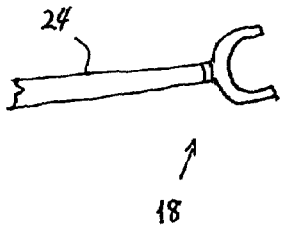
FIG. 2 shows A U-shaped foot harness.
Figure 3:
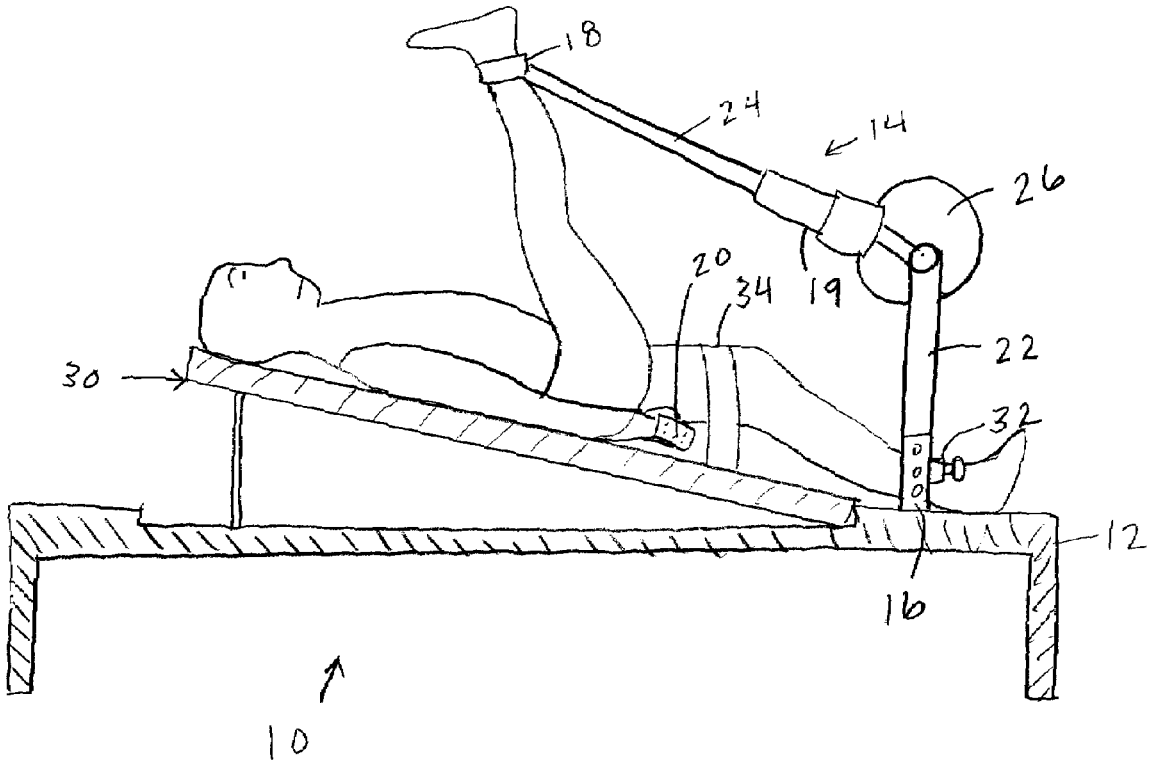
FIG. 3 illustrates an exemplary stretching machine with the bench manually elevated.

Referring to FIGS. 2 and 3, the foot attachment 18 comprises a u-shaped foot harness. The first member 22 is substantially perpendicular to the bench and comprises a manual height adjuster 32 to vary the height of the first member 22. The exercise machine 10 also includes a motor 28 for the actuator 19. The exercise machine further comprises a manually adjustable bench pad 30 for increasing and decreasing the angle of the user's leg to the second member 24 of the actuator arm 14. The bench 12 also includes a manually adjustable bench pad 30 that is used to increase or decrease the user's distance to the actuator arm 14. The exercise machine further comprises a remote control 20 for the actuator arm 14. The remote control 20 comprises an electronic gauge for measuring progression of the angle between the first and second arm members. The exercise machine 10 also includes a strap 34 to attach the leg of the user not being stretched to the bench 12 and to keep the user's body flat on the bench 12. The strap 34 comprises a hook and loop fastener (e.g., VELCRO®).

Therefore, while there has been described what is presently considered to be the preferred embodiment, it will understood by those skilled in the art that other modifications can be made within the spirit of the invention.

What is claimed is:

1. An exercise machine comprising:

a bench for a user to lie upon;

an actuator arm comprising a first member further comprising a connection to the bench at a first end and a second member including a foot attachment at a second end for attaching to a user's foot, wherein the first and second members are connected to each other by a joint allowing freedom of movement such that the first and second members form a variable angle with respect to each other, wherein the first member is substantially perpendicular to the bench and comprises a manual height adjustor to vary the height of the first member;

said actuator arm further including an actuator for moving the actuator arm such that a user's leg is moved into a stretching position;

the bench including a manually adjustable bench pad for increasing and decreasing the angle of the user's leg to the actuator arm; and a user control for causing the actuator to actuate.

2. The exercise machine of claim 1, wherein the second member comprises an actuator piston.

3. The exercise machine of claim 1, wherein the joint comprises a manually adjustable gear for altering the variable angle.

4. The exercise machine of claim 1, wherein the foot attachment comprises a u-shaped foot harness.

5. The exercise machine of claim 1, wherein the second member comprises a pneumatic piston arm.

* * * * *